US008240983B2

(12) United States Patent
Suljak, Jr. et al.

(10) Patent No.: US 8,240,983 B2
(45) Date of Patent: Aug. 14, 2012

(54) GAS TURBINE ENGINE SYSTEMS INVOLVING GEAR-DRIVEN VARIABLE VANES

(75) Inventors: George T. Suljak, Jr., Vernon, CT (US); Michael G. McCaffrey, Windsor, CT (US)

(73) Assignee: United Technologies Corp., Hartford, CT (US)

( * ) Notice: Subject to any disclaimer, the term of this patent is extended or adjusted under 35 U.S.C. 154(b) by 565 days.

(21) Appl. No.: 11/876,244

(22) Filed: Oct. 22, 2007

(65) Prior Publication Data

US 2009/0104022 A1 Apr. 23, 2009

(51) Int. Cl.
*F01D 17/16* (2006.01)

(52) U.S. Cl. ..... 415/160

(58) Field of Classification Search ..... 415/160, 415/161

See application file for complete search history.

(56) References Cited

U.S. PATENT DOCUMENTS

| | | | | |
|---|---|---|---|---|
| 2,819,732 | A * | 1/1958 | Paetz | 138/46 |
| 3,352,537 | A | 11/1967 | Alexander | |
| 4,430,043 | A | 2/1984 | Knight et al. | |
| 4,979,874 | A | 12/1990 | Myers | |
| 5,277,544 | A | 1/1994 | Naudet | |
| 5,630,701 | A | 5/1997 | Lawer | |
| 6,039,534 | A | 3/2000 | Stoner et al. | |
| 6,435,821 | B1 | 8/2002 | Nicolson et al. | |
| 6,767,183 | B2 | 7/2004 | Schilling et al. | |
| 6,984,104 | B2 | 1/2006 | Alexander et al. | |
| 7,155,222 | B1 | 12/2006 | Jain et al. | |
| 7,223,066 | B2 | 5/2007 | Rockley | |
| 2007/0020090 | A1 * | 1/2007 | Giaimo et al. | 415/160 |

FOREIGN PATENT DOCUMENTS

| | | |
|---|---|---|
| GB | 1466613 | 3/1977 |
| GB | 1505858 | 3/1978 |

* cited by examiner

*Primary Examiner* — Edward Look
*Assistant Examiner* — Jesse Prager

(57) ABSTRACT

Gas turbine engine systems involving gear-driven variable vanes are provided. In this regard, a representative gas turbine engine system includes: a ring gear assembly operative to be mounted within an engine casing; and a vane module having a first vane airfoil and a first gear, the first gear being operative to engage the ring gear assembly such that movement of the ring gear alters a position of the first vane airfoil.

15 Claims, 5 Drawing Sheets

GAS TURBINE ENGINE SYSTEMS INVOLVING GEAR-DRIVEN VARIABLE VANES

BACKGROUND

1. Technical Field

The disclosure generally relates to gas turbine engines.

2. Description of the Related Art

Many gas turbine engines incorporate variable stator vanes, the angle of attack of which can be adjusted. Conventionally, implementation of variable vanes involves providing an annular array of vanes, with each of the vanes being attached to a spindle. The spindles extend radially outward through holes formed in the engine casing in which the vanes are mounted. Each of the spindles is connected to a lever arm that engages a unison ring located outside the engine casing. In operation, movement of the unison ring pivots the lever arms, thereby rotating the spindles and vanes.

SUMMARY

Gas turbine engine systems involving gear-driven variable vanes are provided. In this regard, an exemplary embodiment of a gas turbine engine system comprises: a ring gear assembly operative to be mounted within an engine casing; and a vane module having a first vane airfoil and a first gear, the first gear being operative to engage the ring gear assembly such that movement of the ring gear alters a position of the first vane airfoil.

An exemplary embodiment of a gas turbine engine comprises: a compressor; a combustion section operative to receive compressed air from the compressor; a turbine operative to drive the compressor; a casing operative to encase the turbine; and a gear-driven variable vane system having a ring gear assembly and a vane module, the ring gear assembly being mounted within an interior of the casing, the vane module having a first vane airfoil and a first gear, the first gear being operative to engage the ring gear assembly such that movement of the ring gear alters a position of the first vane airfoil.

An exemplary embodiment of a vane module for a gas turbine engine comprises: an inner platform, an outer platform, a first vane airfoil and a first gear, the first vane airfoil extending between the inner platform and the outer platform, the vane module being operative to rotate the first vane airfoil relative to the inner platform and the outer platform, responsive to rotation of the first gear.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engine systems involving gear-driven variable vanes are provided, several exemplary embodiments of which will be described in detail. In some embodiments, the vanes are incorporated into rotatable vane modules. Gears of the vane modules are engaged between opposing gear teeth of annular ring gears that are positioned within the engine casing.

Figure 1:
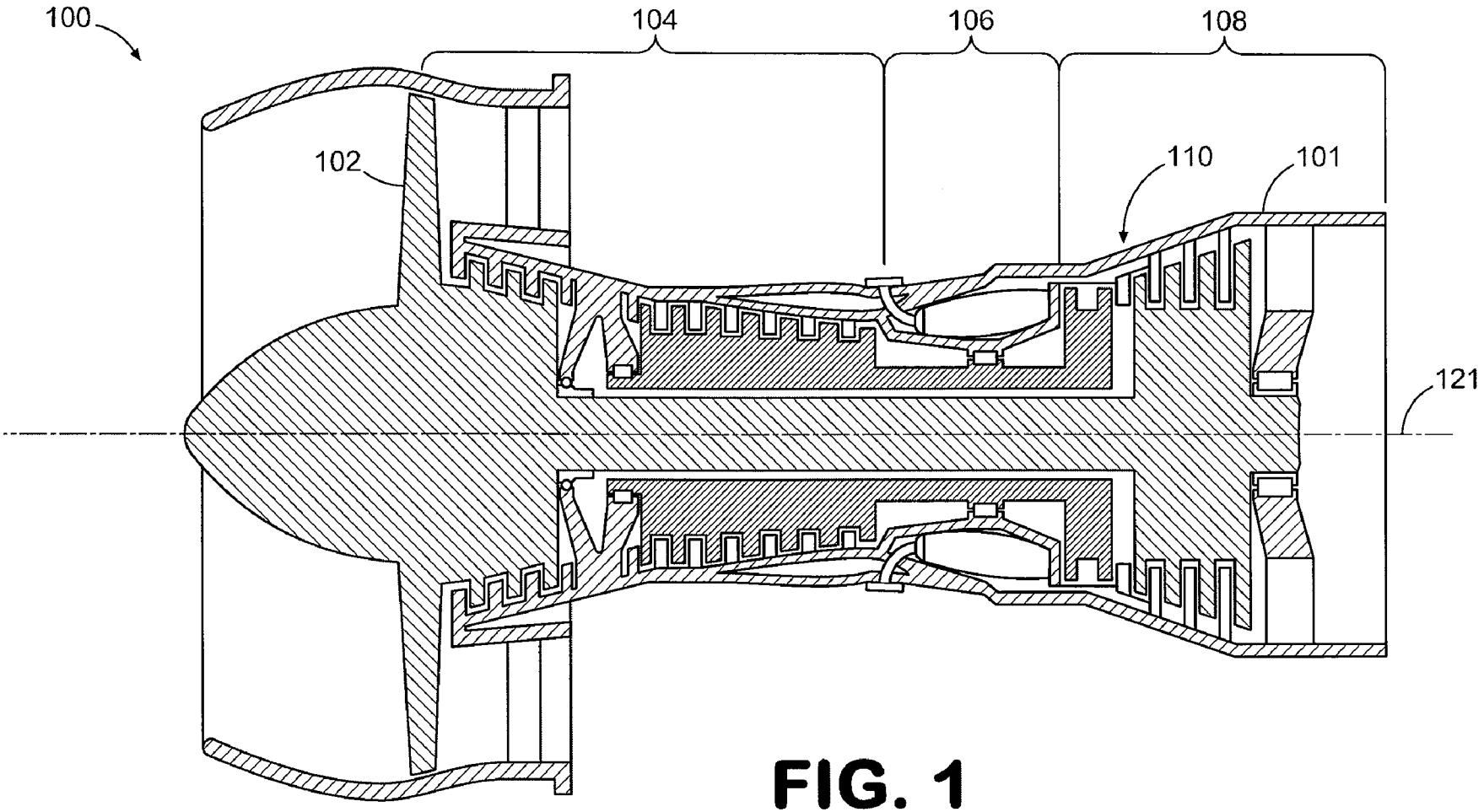
FIG. 1 is a schematic diagram depicting an exemplary embodiment of a gas turbine engine.

FIG. 1 is a schematic diagram of a gas turbine engine 100. Engine 100 incorporates an engine casing 101 that houses a fan 102, a compressor section 104, a combustion section 106 and a turbine section 108. Engine 100 also incorporates a gear-driven variable vane assembly 110. Although depicted in FIG. 1 as a turbofan gas turbine engine, there is no intention to limit the concepts described herein to use with turbofans as other types of gas turbine engines can be used.

Figure 2:
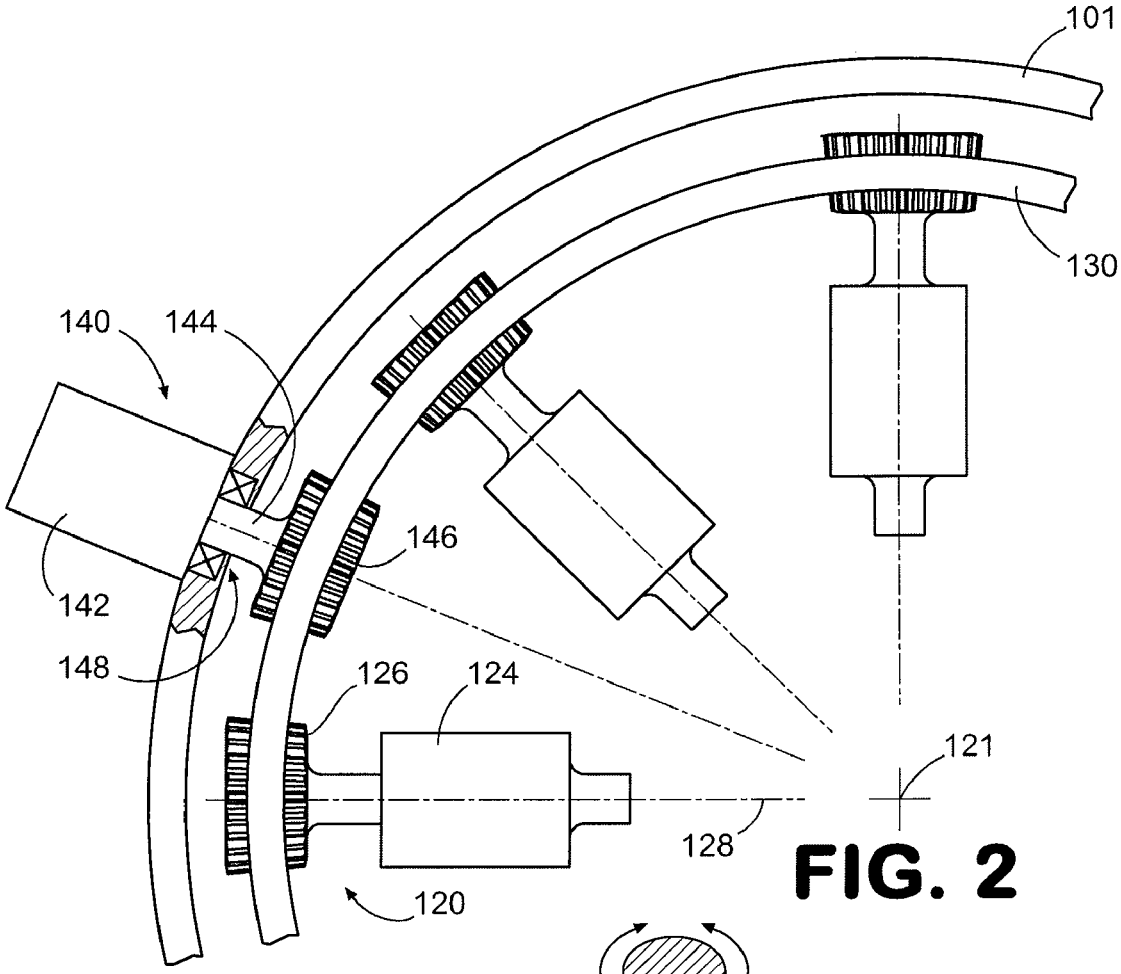
FIG. 2 is a schematic diagram depicting a portion of the variable vane assembly of the embodiment of FIG. 1.

As shown in the partially cut-away, schematic diagram of FIG. 2, vane assembly 110 includes an annular arrangement of vane modules (e.g., module 120) positioned within the engine casing 101 about a longitudinal axis 121. Each of the vane modules includes one or more vanes (e.g., vane 124). Each vane module also includes a module gear (e.g., module gear 126) that is used to rotate the vane(s) of the module about the center axis of the gear. By way of example, gear 126 rotates vane 124 about axis 128.

Each vane module engages a ring gear assembly 130. Notably, the ring gear assembly is positioned within the engine casing. A motor assembly 140 also is provided that includes a motor 142 (positioned outside the engine casing), a shaft 144 and a drive gear 146. In the embodiment of FIG. 2, motor 142 is a stepper motor.

Shaft 144 extends from the motor into the interior of the engine casing via a penetration 148. A distal end of the shaft is attached to drive gear 146, which engages the ring gear assembly so that operation of the motor rotates the drive gear, thereby actuating the ring gear assembly. Actuation of the ring gear assembly rotates the module gears, thereby positioning the vanes.

Figure 3:
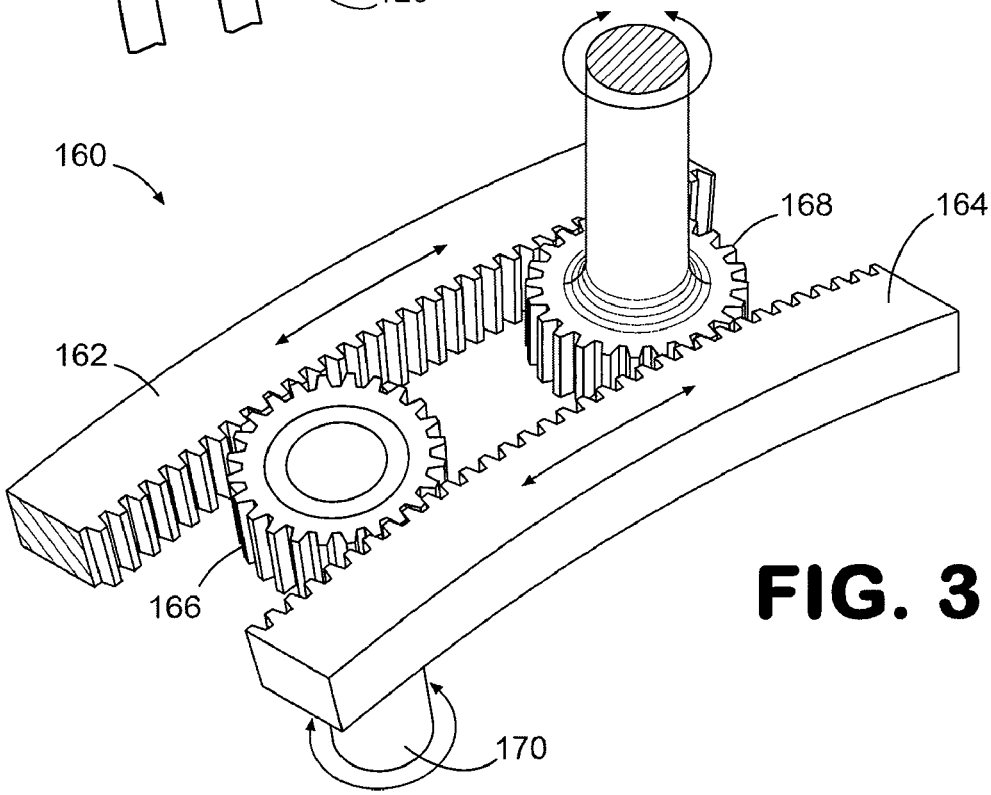
FIG. 3 is a schematic diagram showing detail of the opposing gear rings of another embodiment.

Another embodiment is depicted schematically in FIG. 3. As shown in FIG. 3, ring gear assembly 160 incorporates opposing ring gears 162, 164, the teeth of which face inwardly. A vane module gear 166 and drive gear 168 are engaged between the ring gears. Notably, use of this dual-ring configuration applies torque to the center of the axis of rotation of the vane module gear, thereby tending to reduce thrust loads on the spindle 170. This configuration also tends to accommodate thermal growth by allowing radial motion of the vane module gear with respect to the ring gears. Radial engagement of vane module gears about the circumference of the ring gear assembly also tends to self-center the ring gears regardless of the position of the vane modules. This tends to simplify positioning and tends to avoid radial binding due to thermal growth effects.

Figure 4:
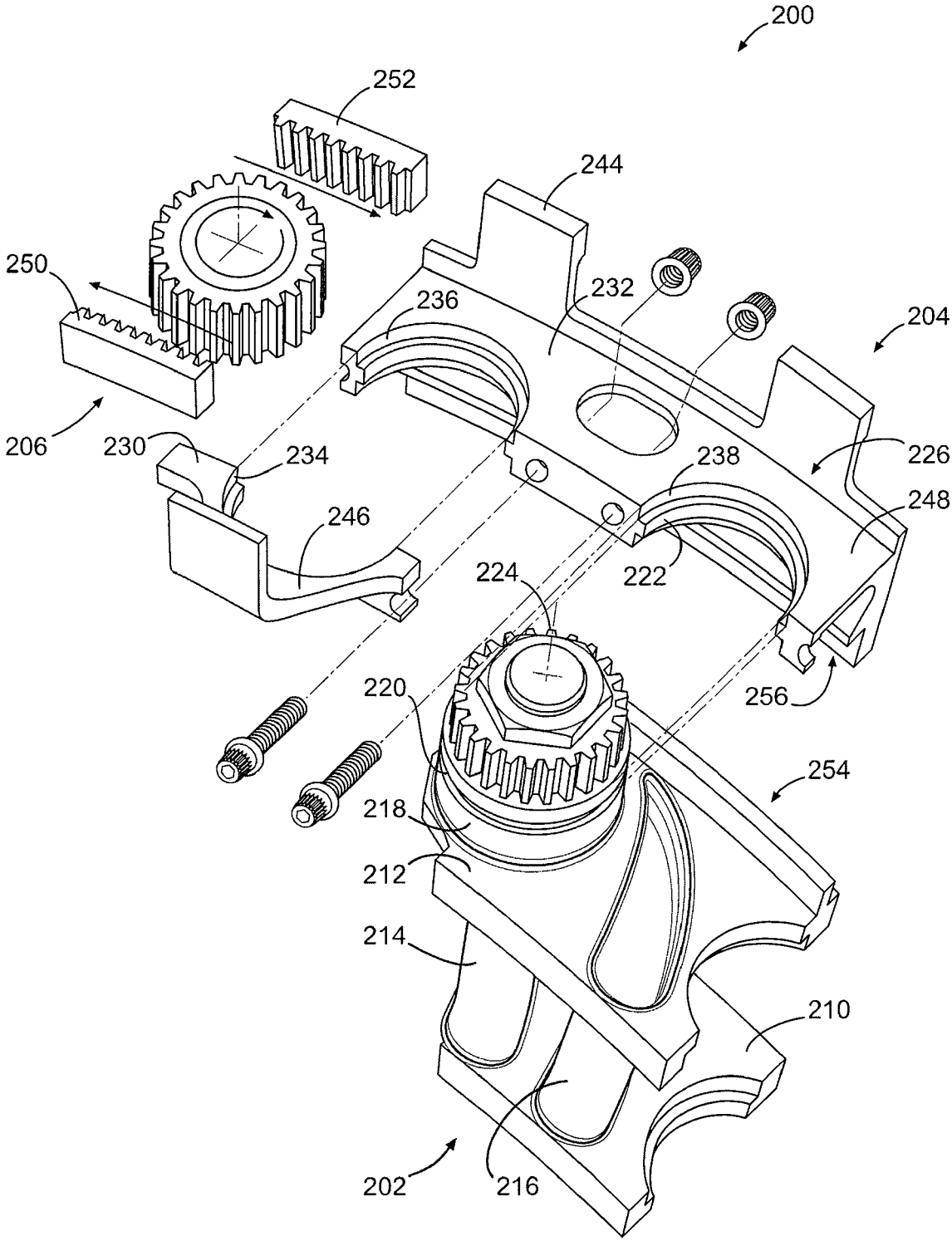
FIG. 4 is a partially-exploded, schematic view of an exemplary embodiment of a system involving gear-driven variable vanes.

FIG. 4 is an exploded, schematic view of a portion of another embodiment of a gas turbine engine system involving gear-driven variable vanes. As shown in FIG. 4, system 200 includes a vane module 202 (only one of which is depicted in FIG. 4), a mounting assembly 204, and a ring gear assembly 206. Vane module 202 includes an inner platform 210, an outer platform 212 and at least one vane airfoil extending between the platforms. In the embodiment of FIG. 4, the vane module is configured as a doublet, i.e., two airfoils 214, 216 are provided, with the airfoils of the doublet moving relative to the vane module. In other embodiments, various other numbers and configurations of airfoils can be used.

Vane module 202 also includes a spindle 218 that extends radially outwardly from the outer platform. In this embodiment, the spindle includes a spindle feature 220 (e.g., an annular recess) that mates with a corresponding feature 222 (e.g., a ridge) of the mounting assembly. The spindle supports the first vane module gear 224 that extends into a track 226 of the mounting assembly.

In this regard, mounting assembly 204 is provided in a split-ring configuration that includes a forward annular member 230 and an aft annular member 232. The annular members include split apertures that engage about the vane module spindles. For instance, member 230 includes a split aperture 234 and member 232 includes a split aperture 236 that engage each other to form an aperture in which a spindle is received. As another example, spindle 218 is received by split aperture 238 of member 232 and a corresponding split aperture of member 230 (not shown).

The mounting assembly also includes outwardly extending tabs (e.g., tab 244) that facilitate attachment of the mounting assembly to the interior of an engine casing. So mounted, the engine casing, the tabs and respective outer surfaces 246, 248 of the annular members 230, 232 form track 226 within which the opposing ring gears 250, 252 of the ring gear assembly 206 are located.

Additionally, the vane outer platform 212 has a mating feature 254 that is in close contact with the mating surface 256 on the split ring member 232 to prevent the vane module 202 from rotating relative to the split ring mounting assembly 204. The mounting assembly 204 is located within the case 101 such that the axial and tangential loads created during the operation of the engine are transmitted from the vane module 202, through the spindle feature 220, into the mount assembly 204. The mount assembly 204 can move radially relative to the case 101 so that thermally induced loads are not transmitted into the case 101.

The mounting assembly 204, supports the vane modules 202 in the radial direction by the restraint of the outer platform 212 through interaction between spindle feature 220 and feature 238. In this embodiment, the radial growth of the inner platform 210 is not constrained by the mount assembly 204, thus avoiding adverse loading. The inner platform 210 relative position to the outer platform 212 is maintained by the first vane airfoil 214 and the second vane airfoil 216.

Figure 5:
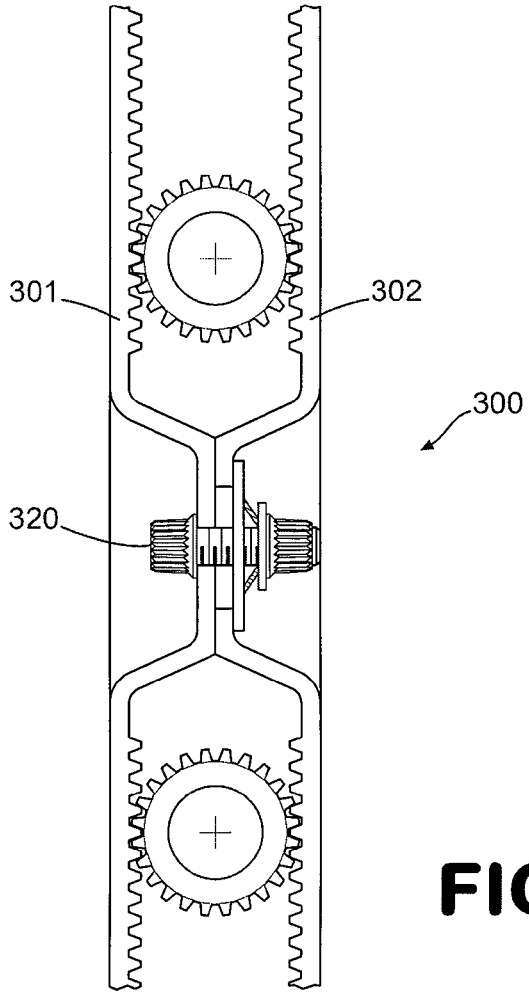
FIG. 5 is a schematic diagram depicting an exemplary embodiment of a compression mechanism.
Figure 6:
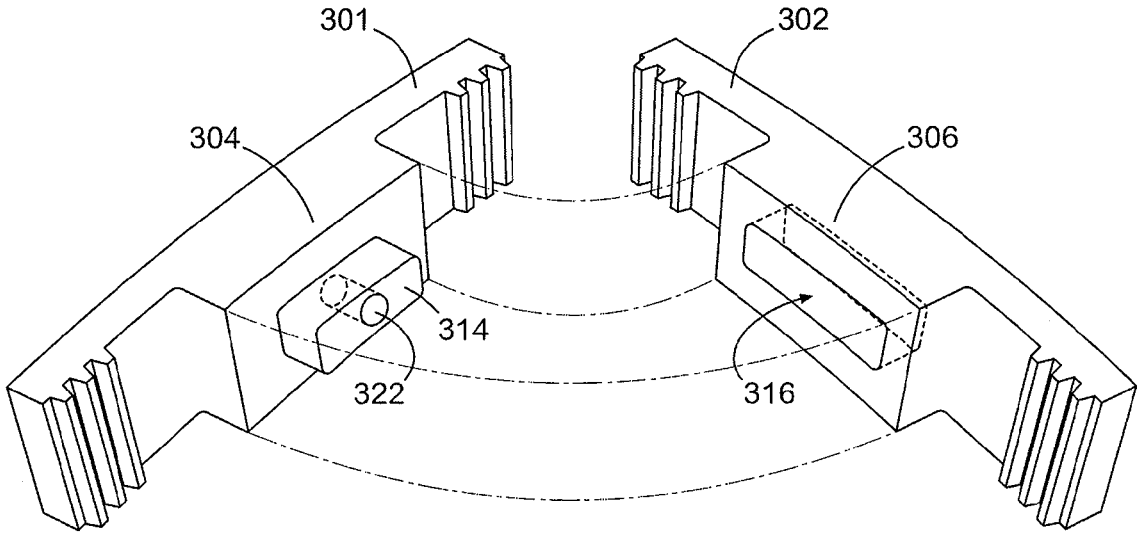
FIG. 6 is a schematic diagram depicting detail of the compression mechanism of FIG. 5.

Various techniques and/or mechanisms can be used for promoting desired engagement between the opposing ring gears. In this regard, reference is made to the schematic diagrams of FIGS. 5 and 6, which depict an embodiment of a compression mechanism 300. As shown in FIG. 5, portions of ring gears 301 and 302 are configured to contact each other. Specifically, ring gear 301 includes a contact member 304 and ring gear 302 includes a contact member 306. The contact members are located at positions of the ring gears that are not intended to contact vane module gears. Thus, a ring gear assembly can include multiple sets of contact members in a spaced arrangement about the ring gears.

In FIG. 5, the contact members extend toward each other. As shown in greater detail in FIG. 6, contact member 304 is a non-geared portion of ring gear 301 that incorporates a protrusion 314, whereas contact member 306 is a non-geared portion of ring gear 302 that incorporates a recess 316. In this embodiment, both the protrusion and recess are generally rectangular and are secured in a mated position by a fastener 320 (FIG. 5) that is received within a bore 322. When secured in the mated position in which the protrusion is seated within the recess (FIG. 5), the gear teeth of the ring gears are compressed into contact with the gear teeth of the module gears in a vicinity of the compression mechanism 300.

Notably, in this embodiment, slot 316 is longer in the circumferential direction than the protrusion 314 to allow the ring 304 to move concentrically with ring 306 about axis 121. However, slot 316 is not substantially larger in radial thickness than the protrusion 314 to prevent relative motion of the center of ring 304 and the center of ring 306. The relative difference in length between slot 316 and the protrusion 314 may be used to restrict the overall rotation of ring 304 relative to ring 306, about axis 121.

The fastener 320 is held in position by bore 322, and uses a spring feature 324 (FIG. 5), acting upon ring 302, to pull ring 301 and ring 302 together while still allowing the relative motion between the rings.

Figure 7:
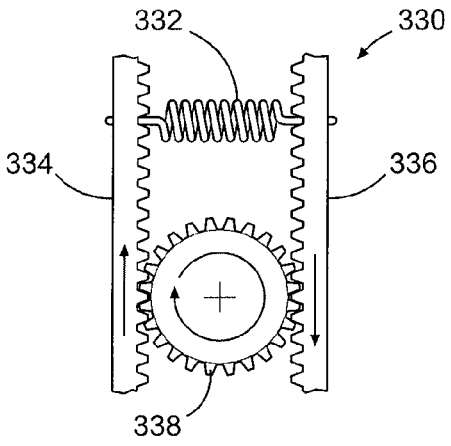
FIG. 7 is a schematic diagram depicting another exemplary embodiment of a compression mechanism.

FIG. 7 is a schematic diagram depicting another embodiment of a compression mechanism. As shown in FIG. 7, the compression mechanism 330 includes a biasing member 332 that extends between ring gear 334 and ring gear 336. Specifically, the biasing member (e.g., a spring) biases the ring gears toward each other in a vicinity of a vane module gear (e.g., gear 338).

The spring 332 is mounted to rings 334 and 336 such that the rings are free to rotate relative to each other about axis 121. The spring 332 rotates as needed, within rings 334 and 336, and applies an increasing load, pulling the rings 334 and 336 together as the relative distance between the end points of spring 332 increase, i.e., the spring is always pulling the two rings 334 and 336 together.

Figure 8:
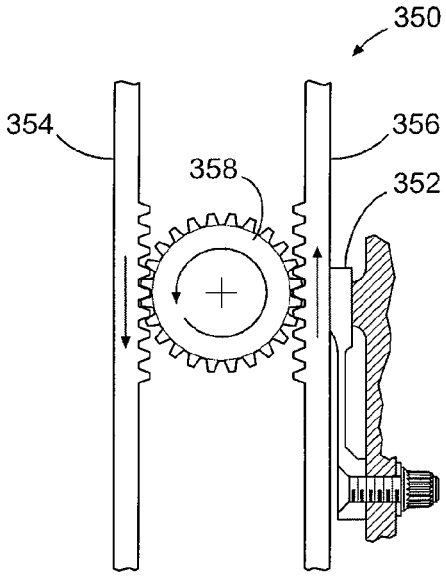
FIG. 8 is a schematic diagram depicting another exemplary embodiment of a compression mechanism.

FIG. 8 is a schematic diagram depicting another embodiment of a compression mechanism. As shown in FIG. 8, the compression mechanism 350 includes a biasing member 352 that is configured as a leaf spring. The leaf spring biases the ring gears 354 and 356 toward each other in a vicinity of vane module gear 358. Compression mechanism 350 may be complimented with a similar compression member on the opposite side of the ring assembly, ensuring equal loading, or constraining the ring 354 and 356 to a limited range of motion in the direction of axis 121. Compression member 350 may also be installed on the inside or outside surfaces of rings 354 and/or 356 to prevent, or limit, motion of the center of rings 354 and/or 356 from the axis 121.

Figure 9A:
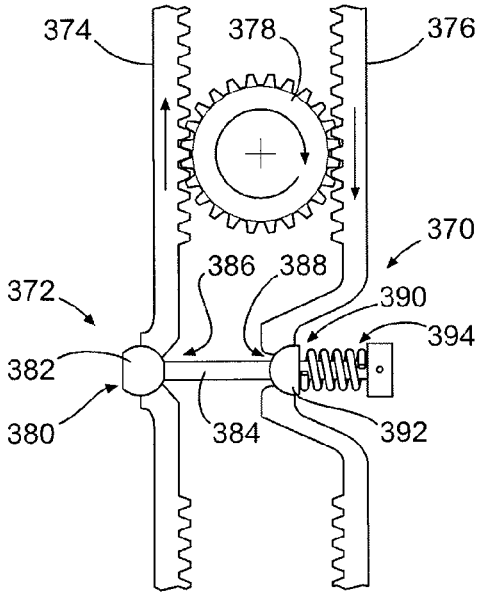
FIG. 9A is a schematic diagram depicting another embodiment of a compression mechanism.
Figure 9B:
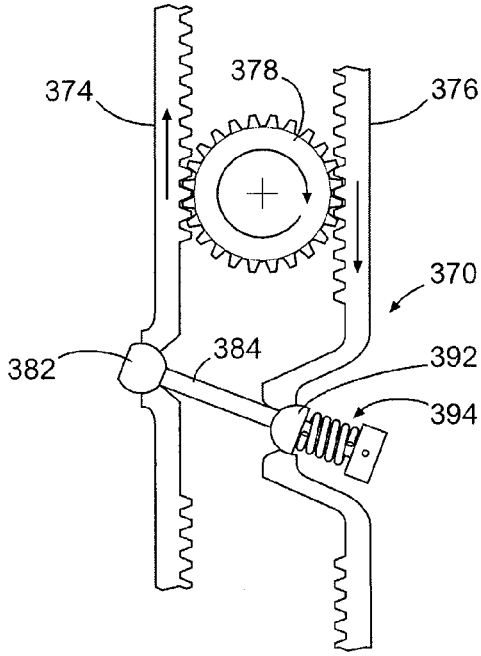
FIG. 9B is a schematic diagram showing the embodiment of FIG. 9A responsive to the drive gear being rotated.

In contrast to the embodiments of FIGS. 5 through 8, compression mechanism 370 of FIGS. 9A and 9B incorporates a biasing member 372 that biases ring gears 374, 376 to a neutral position in addition to compressing the ring gears against a vane module gear 378. Specifically, as shown in FIG. 9A, ring gear 374 includes a socket 380 in which a ball joint 382 is received. A connector 384 extends from the ball joint, through an aperture 386 formed in the socket. The connector extends through an aperture 388 of corresponding socket 390 of ring gear 376 and terminates in an opposing ball joint 392.

The connector 384 extends through ball joint 392, and can move relative to the ball joint 392 about an axis defined by the longitudinal axis of the connector 384. A spring assembly 394, attached to the end of connector 384, applies a load to the ball joint 392. The spring pulls upon connector 384, which also applies a load on socket 380. Thus, opposing forces created by spring preload act upon socket 380 and ball joint 392, through connector 384, such that rings 374 and 376 are pulled together.

The relative rotation of rings 374 and 376, about axis 121, causes the connector 384 to rotate in the ball joint 382 in socket 380 and ball joint 392 in socket 390. The increase in distance between the center of ball joints 382 and 392 results in the compression of the spring mounted to connector 384, and a corresponding increase in the load pulling rings 374 and 376 together. Selection of the spring strength (spring rate) and the length of connector 384 will allow rotation motion of the rings 374 and 376 to occur as desired, without causing binding, or excessive loads in connector 384.

In some embodiments, the shape of the contact surface between ball joints 380, 382, 390 and 392 may be spherical, cylindrical, or a combination of the two, as desired to control the relative motion of rings 374 and 376.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A gas turbine engine system comprising:

a ring gear assembly operative to be mounted within an engine casing, wherein the ring gear assembly comprises a first ring gear and a second ring gear;

a vane module having a first vane airfoil and a first gear, the first gear being operative to engage the ring gear assembly such that movement of at least one of the ring gears alters a position of the first vane airfoil;

wherein the ring gears have opposing gear teeth operative to engage the first gear of the vane module therebetween; and a compression mechanism including a biasing member operative to bias the ring gears towards each other in a vicinity of the first gear of the vane module.

2. The system of claim 1, further comprising a mounting assembly defining an annular track along which the ring gear assembly is carried.

3. The system of claim 2, wherein:

the mounting assembly exhibits a split-ring configuration having a forward annular member and an aft annular member; and the forward member and the aft member engage each other to mount the vane module.

4. The system of claim 1, wherein:

the vane module further comprises an inner platform and an outer platform, the first vane airfoil extending between the inner platform and the outer platform; and the vane module is operative to rotate the first vane airfoil relative to the inner platform and the outer platform, responsive to rotation of the first gear.

5. The system of claim 4, wherein the vane module further comprises a second vane airfoil extending between the inner platform and the outer platform such that the first vane airfoil rotates relative to the second vane airfoil, the inner platform and the outer platform, responsive to rotation of the first gear.

6. The system of claim 1, further comprising:

a motor;

a shaft extending from the motor; and a drive gear attached to the shaft and being operative to engage the ring gear assembly.

7. The system of claim 1, wherein the compression mechanism is operative to urge the ring gear assembly into engagement with the first gear of the vane module.

8. The system of claim 1, wherein:

the ring gear assembly comprises a first ring gear and a second ring gear;

the first ring gear is operative to move circumferentially with respect to the second ring gear.

9. The system of claim 2, wherein:

the mounting assembly exhibits a split-ring configuration having a forward annular member and an aft annular member;

the forward annular member has a split aperture and the aft annular member has a corresponding split aperture; and a portion of the vane module is captured between the split aperture and the corresponding split aperture.

10. A gas turbine engine comprising:

a compressor;

a combustion section operative to receive compressed air from the compressor;

a turbine operative to drive the compressor;

a casing operative to encase the turbine; and a gear-driven variable vane system having a ring gear assembly and a vane module, the ring gear assembly being mounted within an interior of the casing and comprising a first ring gear and a second ring gear, the vane module having a first vane airfoil and a first gear, the first gear being operative to engage the ring gear assembly such that movement of the ring gear alters a position of the first vane airfoil;

wherein the first ring gear and the second ring gear have opposing gear teeth operative to engage the first gear of the vane module therebetween:

a compression mechanism including a biasing member operative to bias the ring gears towards each other in a vicinity of the first gear of the vane module.

11. The engine of claim 10, wherein:

the vane module is a first vane module of a vane assembly having multiple vane modules; and the vane modules are annularly positioned about a longitudinal axis of the engine.

12. The engine of claim 10, further comprising a mounting assembly located within the interior of the casing and defining an annular track along which the ring gear assembly is carried.

13. The engine of claim 12, wherein:

the mounting assembly exhibits a split-ring configuration having a forward annular member and an aft annular member; and the forward member and the aft member engage each other to mount the vane module.

14. The system of claim 10, further comprising:

a motor located outside of the casing;

a shaft extending from the motor and into the casing; and a drive gear attached to the shaft and positioned in the interior of the casing, the drive gear being operative to engage the ring gear assembly.

15. The engine of claim 12, wherein:

the mounting assembly exhibits a split-ring configuration having a forward annular member and an aft annular member;

the forward annular member has a split aperture and the aft annular member has a corresponding split aperture; and a portion of the vane module is captured between the split aperture and the corresponding split aperture.

* * * * *